United States Patent [19]

Zintz et al.

[11] 4,300,858

[45] Nov. 17, 1981

[54] VARIABLE DAM

[76] Inventors: Howard C. Zintz; Walter A. Zintz, both of 260 Marshall Dr., Walnut Creek, Calif. 94598

[21] Appl. No.: 142,760

[22] Filed: Apr. 22, 1980

[51] Int. Cl.[3] ..... E02B 7/40

[52] U.S. Cl. ..... 405/100; 405/87

[58] Field of Search ..... 405/87, 88, 99, 100, 405/101, 102

[56] References Cited

U.S. PATENT DOCUMENTS 4,146,346 3/1979 Salo ..... 405/87 X

FOREIGN PATENT DOCUMENTS 168941 9/1951 Austria ..... 405/100

216294 11/1909 Fed. Rep. of Germany ..... 405/99

54220 5/1862 France ..... 405/100

652734 3/1929 France ..... 405/99

*Primary Examiner*—David H. Corbin

*Attorney, Agent, or Firm*—Lothrop & West

[57] ABSTRACT

A variable dam for a water channel having a longitudinal flow axis includes a frame having a bottom member extending across the channel and upright end members. A plurality of approximately planar plates are each connected by a pivot pin at one lower corner to a journal in the bottom member, the plates being in overlapping or staggered relationship with their respective planes approximately normal to the flow axis. The plates are movable by motors effective to rotate at least some of the pivot pins and are assisted in moving simultaneously by a link pivotally connected to each panel near an upper corner thereof. Guys extend to the panels from anchor blocks in the channel either upstream, or downstream, or both.

9 Claims, 4 Drawing Figures

VARIABLE DAM

BRIEF SUMMARY OF THE INVENTION

A multi-panel dam extends across a water channel. The individual panels are mounted in overlapping relationship to each other. They are each provided with a pivot at a lower corner and are connected to the bottom member of a U-shape frame extending across the channel at a small angle to the longitudinal flow axis of the channel. Appropriate recesses or slots are provided in the upright end members of the U-shaped frame to receive one or a plurality of the endmost panels. Preferably the panels are pivotally joined at their upper corners to a transverse link and are also provided with upstream or downstream guys. Drivers are connected to at least some of the pivots and are effective to rotate the panels between an upright, damming position and a lowermost, releasing position.

DETAILED DESCRIPTION

Figures 1, 2:
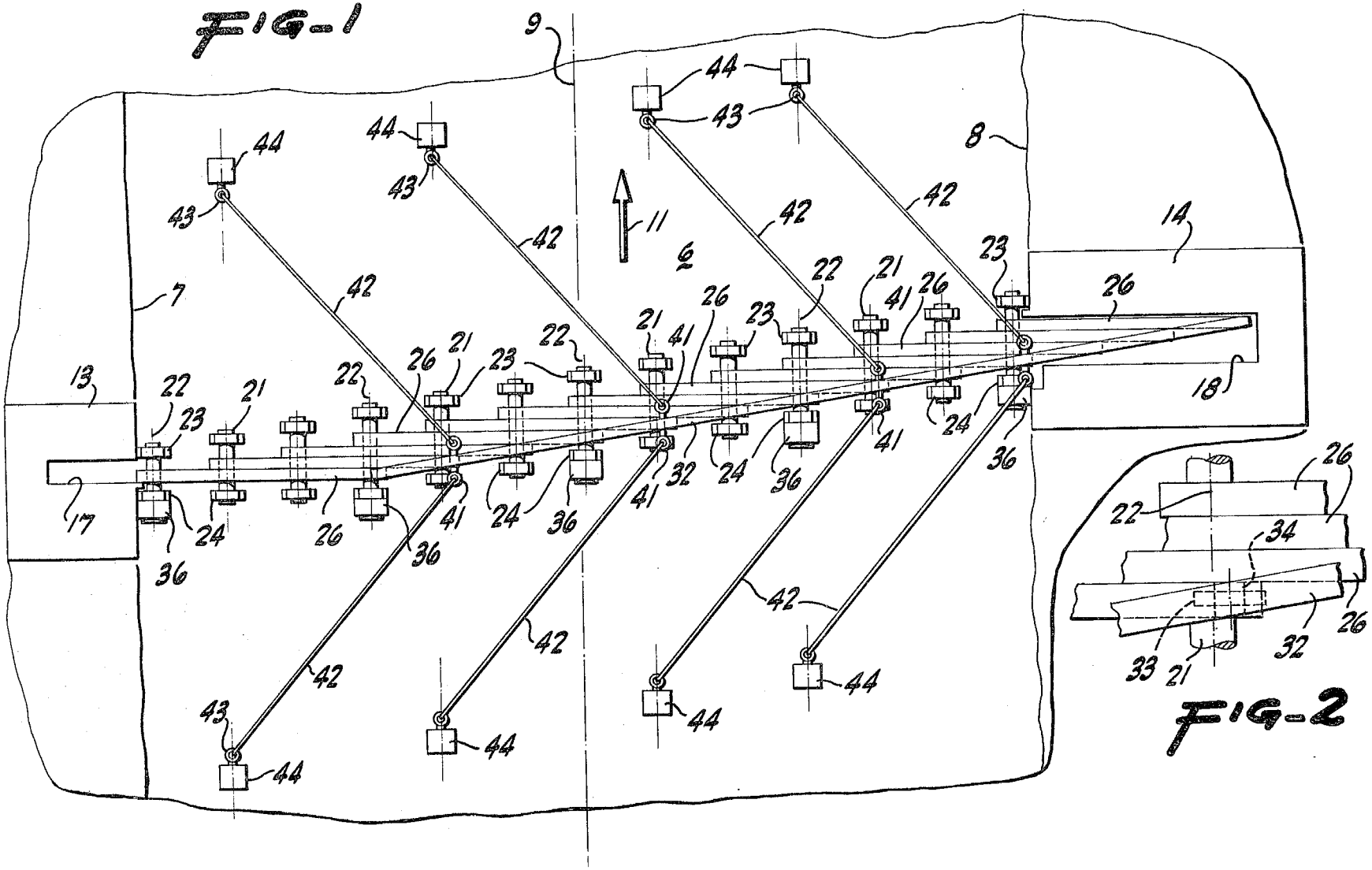
FIG. 1 is a plan of the variable dam in its lowermost position.
FIG. 2 is an enlarged detail showing one version of the top connection of one of the panels or plates to the top link.

The present variable dam is for use in a waterway 6 or channel having nominal banks 7 and 8 at opposite sides and being approximately symmetrical about a longitudinal flow axis 9 arbitrarily assumed to be in the center of the channel and being substantially parallel to the banks 7 and 8. Which direction of flow is downstream is arbitrary, although downstream is indicated herein by the directional arrow 11 in FIG. 1.

In accordance with the invention, there is provided on opposite banks of the stream a pair of upright end members 13 and 14, preferably considered as part of a frame also including a bottom panel 16 extending substantially horizontally across the width of the stream. It may be assumed for present purposes that the frame is comprised of reinforced concrete or the like and is preferably an integral structure. The upright end members 13 and 14 are formed with a recess 17 in the upright 13 and a recess 18 in the upright 14.

Although the upright members 13 and 14 on opposite banks of the channel are generally or approximately across from each other, they are actually offset a short distance in the direction of the longitudinal axis 9 of the stream, so that while the recesses 17 and 18 are parallel to each other, they are not directly opposite each other.

Anchored in the bottom panel 16 and preferably equally spaced apart transversely of the stream and disposed with their axes parallel to each other and to the axis 9 is a plurality of pivot pins generally designated 21. Some of these differ somewhat, although they are generally substantially similar and are disposed with their axes 22 located just above the upper surface of the panel 16 and parallel to each other and to the longitudinal axis 9 and in a principal horizontal plane.

Figure 3:
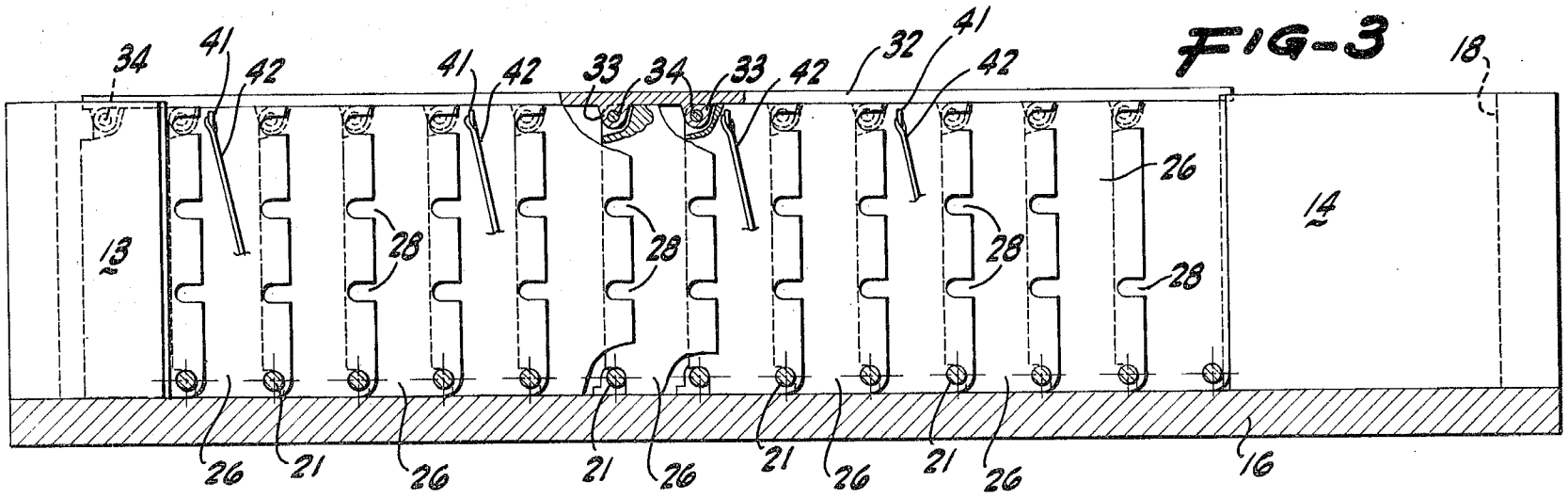
FIG. 3 is a side elevation of the dam in erected or upright position, certain portions being shown in cross-section and certain parts being broken away to show in cross-section some of the details of construction.

Each one of the pivot pins 21 is mounted in bearings 23 and 24 appropriately anchored in the panel 16 and is interconnected with a corresponding upstanding panel 26. The connection between a pin and its panel is preferably at a lowermost corner of the panel, as especially shown in FIG. 3. Thus, the panel and the pin can rotate simultaneously about their individual axis 22. The panel so can move or rotate between a generally lower, horizontal position extending crosswise of the channel and with its plane normal to the axis 9 and an upper, upright position. Therein the full height of the panel extends from the bottom of the channel to the top of the waterway.

The several panels are always in overlapping relationship, being spaced relatively closely to each other to minimize leakage. They are arranged so that in their upright position one or two of the endmost panels can be received in the recess or channel 17, and in their lowermost position several of the panels can be received side by side in the recess or channel 18.

The arrangement is such that the various panels in effect make up a plurality of movable plates that engage each other well enough to minimize leakage but freely enough for ready movement. The general trend or direction of the panels, although generally transverse of the channel, is at a slight angle because of the axial offset or overlap of the individual plates with respect to each other.

In their lowermost position, the various panels would interfere with the adjacent pivots 21 except that each panel is provided with a notch 28 at each location wherein a pin is encountered. The notches 28 overlie or embrace the pins when the panels are in their lowermost position.

In order that the various successive panels will move substantially in unison, there is provided along their upper edges a transversely and longitudinally extending strut 32 or link. This is provided at appropriate intervals with tabs 33 spaced to receive pivot pins 34 interconnecting the tabs and the struts or links. This forms, in effect, a parallelogram mechanism so that all of the panels operate or rotate substantially simultaneously.

Figure 4:
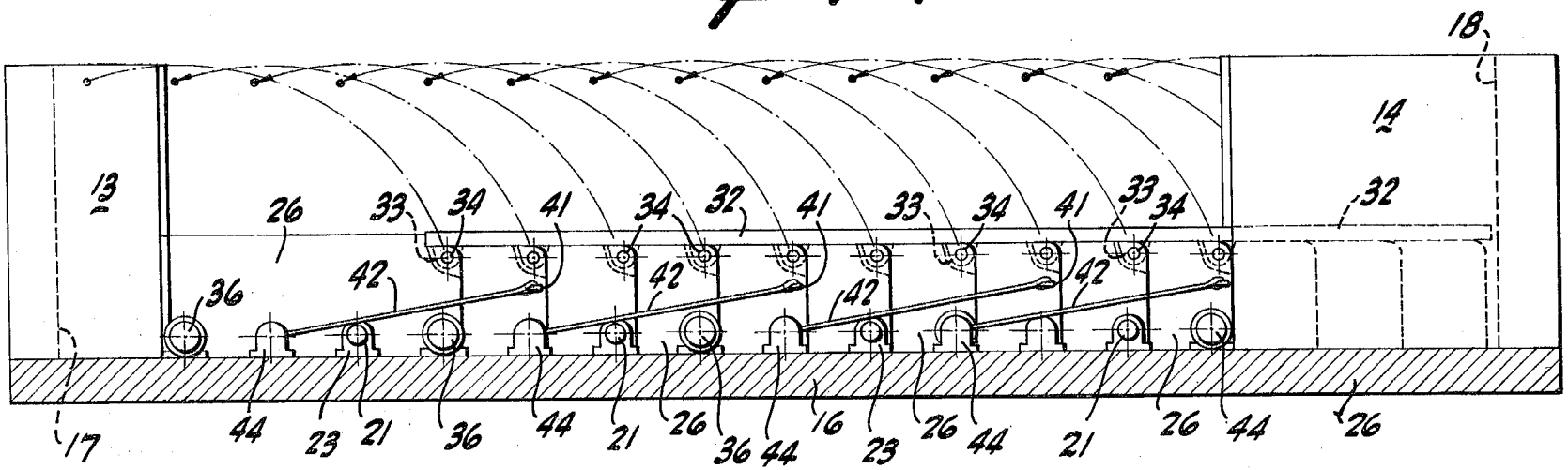
FIG. 4 is a side elevation of the dam in its lowered position, certain parts of the frame being shown in cross-section and the paths of movement of various panels being shown diagrammatically.

While in some small installations a power mechanism for moving the panels may not be needed, in larger installations it is preferred to provide a number of operating motors 36. Often, these are of a hydraulic nature. Each motor is connected to a respective one of the pivot pins 21 to impel the related panel to swing through approximately ninety degrees between its lowermost open position and its uppermost damming position. The motion paths are substantially as indicated by the broken lines in FIG. 4.

With this arrangement, when all of the hydraulic motors are simultaneously operated, it requires a very short time to move the dam from its lower, substantially unobstructing position into its upright, obstructing or damming position, and vice versa.

While the hydraulic motors, being appropriately connected, tend to provide uniform movement of the panels, nevertheless the link or strut ensures that their movements are substantially identical and reduces the number of motors required.

As particularly shown in FIG. 2, the panel positions are always in overlapped relationship, and when the panels are lowered several of the panels extend into the recess 18. The panels as a group extend across the channel at a rather flat transverse angle, the same as the angle at which the various bearings 23 and 24 for the pivot pins are longitudinally offset with respect to each other.

As an additional means for taking some of the load of the impounded water on the panels, some of the panels, at least, are provided with eyes 41 connected by guy wires 42 or cables to similar eyes 43 in anchor blocks 44 on the bottom panel 16 of the dam frame. The eyes 43 in some instances may be pivoted in the blocks 44. As shown in FIG. 1, there are similar guys 42 extending both upstream and downstream of the panels. In most instances, guys on but one side of the panels are needed, but in some installations the direction of flow may be reversed at different seasons of the year or even at different operating periods, so that guys on both sides are then helpful and appropriate.

With an arrangement of the sort disclosed herein, there is provided a dam that can be installed readily in a waterway and that is easily moved from an obstructing or damming position into an unobstructing or releasing position. The amount of power required to effectuate such movement is relatively small since the individual panels are relatively light and, being quite well and pivotally supported, do not require a great deal of power for their operation.

When in its lowermost position the dam is well out of the way of various other uses for the waterway, but when in its upright or erected position is effective to block a body of water therein. In intermediate positions, the dam serves well as a water height regulator.

As an alternative construction, the operating motor or motors 36 can be applied in addition to or alternatively to the top strut 32, or on an individual panel or on several panels. Also, as an alternative to the attitudes or directions, the various panels may be at an angle to the stream axis rather than substantially perpendicular thereto. In some instances, the top of the dam may not be at the same elevation as the water level. In intermediate panel positions, the dam allows self-flushing.

We claim:

1. A variable dam for a longitudinal water channel comprising a frame including a bottom member extending approximately transversely of said channel and including upright members at the ends of said bottom member; a plurality of elongated, planar panels each having a corner; a pivot pin having a longitudinal and horizontal axis interconnecting said corner of each of said panels for rotation relative to said bottom member with said panel in a relationship having an overlap with adjacent ones of said panels; each of said pivot pins being parallel to others of said pivot pins and having a longitudinal offset relative to other pivot pins comparable to said overlap; and means for swinging said panels on said pivot pin axes between substantially horizontal and vertical positions.

2. A device as in claim 1 in which said swinging means moves said panels substantially simultaneously.

3. A device as in claim 1 in which said swinging means includes a link extending along a plurality of said panels, and pivots connecting each of said panels to said link, said pivots having pivotal axes parallel to said longitudinal and horizontal axis.

4. A device as in claim 1 including power means engaging at least one of said pivot pins for rotation thereof.

5. A device as in claim 1 including an anchor block in said water channel spaced from one of said panels, and a guy member extending from said anchor block to said one of said panels.

6. A device as in claim 5 including anchor blocks upstream and downstream of said panels, and guy members extending from said anchor blocks to opposite sides of said panels.

7. A device as in claim 1 including a side edge on one of said panels having a notch to overlie and at least partly to receive a pivot pin of an adjacent one of said panels.

8. A device as in claim 1 in which at least one of said upright end members defines an upright and transversely extending recess adapted to receive a plurality of said panels side by side.

9. A device as in claim 1 in which said upright members of said frame are offset from each other in the direction of the flow axis of the channel.

* * * * *